US005972866A

United States Patent [19]

Ahmed

[11] Patent Number: 5,972,866

[45] Date of Patent: Oct. 26, 1999

[54] THICKENED NONCORROSIVE CLEANER

[75] Inventor: Fahim Uddin Ahmed, Greensboro, N.C.

[73] Assignee: Ecolab, Inc., St. Paul, Minn.

[21] Appl. No.: 08/794,432

[22] Filed: Feb. 5, 1997

[51] Int. Cl.[6] ..... C11D 7/54; C11D 14/02; C11D 3/395; C11D 3/48

[52] U.S. Cl. ..... 510/218; 510/272; 510/380; 510/382; 510/507

[58] Field of Search ..... 510/197, 198, 510/379, 380, 381, 382, 507, 218, 272

[56] References Cited

U.S. PATENT DOCUMENTS

| | | | |
|---|---|---|---|
| 3,558,496 | 1/1971 | Zmoda | 252/95 |
| 3,684,722 | 8/1972 | Hynam et al. | 252/98 |
| 3,843,548 | 10/1974 | James | 25/187 H |
| 4,005,027 | 1/1977 | Hartman | 252/95 |
| 4,011,172 | 3/1977 | Marsan et al. | 252/187 R |
| 4,013,581 | 3/1977 | Huber . | |
| 4,017,411 | 4/1977 | Diehl et al. . | |
| 4,017,412 | 4/1977 | Bradley . | |
| 4,113,645 | 9/1978 | DeSimone . | |
| 4,116,849 | 9/1978 | Leikhim | 252/103 |
| 4,116,851 | 9/1978 | Rupe et al. . | |
| 4,174,289 | 11/1979 | Sorgenfrei et al. . | |
| 4,282,109 | 8/1981 | Citrone et al. . | |
| 4,337,163 | 6/1982 | Schilp . | |
| 4,388,204 | 6/1983 | Dimond et al. | 252/98 |
| 4,399,050 | 8/1983 | Bentham et al. . | |
| 4,561,994 | 12/1985 | Rubin et al. | 252/187.23 |
| 4,585,570 | 4/1986 | Nelson . | |
| 4,588,514 | 5/1986 | Jones et al. . | |
| 4,666,622 | 5/1987 | Martin et al. . | |
| 4,772,414 | 9/1988 | Marzec et al. | 252/103 |
| 4,775,492 | 10/1988 | Vipond et al. . | |
| 4,781,854 | 11/1988 | Overton et al. . | |
| 4,789,495 | 12/1988 | Cahall et al. . | |
| 4,800,036 | 1/1989 | Rose et al. . | |
| 4,828,748 | 5/1989 | Hoffman . | |
| 4,839,077 | 6/1989 | Cramer et al. . | |
| 4,900,469 | 2/1990 | Farr et al. . | |
| 5,034,150 | 7/1991 | Smith . | |
| 5,106,523 | 4/1992 | Peterson . | |
| 5,185,096 | 2/1993 | Ahmed . | |
| 5,196,139 | 3/1993 | Moschner . | |
| 5,213,706 | 5/1993 | Rapisarda et al. . | |
| 5,348,682 | 9/1994 | Finley et al. . | |
| 5,376,297 | 12/1994 | Choy et al. . | |
| 5,384,061 | 1/1995 | Wise . | |
| 5,470,499 | 11/1995 | Choy et al. . | |
| 5,510,047 | 4/1996 | Gabriel et al. . | |
| 5,529,711 | 6/1996 | Brodbeck et al. . | |

FOREIGN PATENT DOCUMENTS

| | | |
|---|---|---|
| 0 635 568 A1 | 1/1995 | European Pat. Off. . |

*Primary Examiner*—Yogendra Gupta
*Assistant Examiner*—John M. Petruncio
*Attorney, Agent, or Firm*—Merchant & Gould P.C.

[57] ABSTRACT

Methods and compositions for cleaning food preparation surfaces are disclosed. The method includes applying a thickened, noncorrosive composition to the surface. The composition is formulated from a hypochlorite bleach used to reduce staining on the surface, an alkalinity source to provide a pH of from about 10 to 14, a thickening agent used to promote adhesion of the composition to the surface upon application, and a balance of water. Optionally, the composition may also contain a surfactant and a builder.

35 Claims, No Drawings

THICKENED NONCORROSIVE CLEANER

A. FIELD OF THE INVENTION

The invention relates generally to the cleaning of hard surfaces with thickened, noncorrosive compositions. More specifically, the invention relates to noncorrosive bleach compositions, preferably thickened with an inorganic thickener, which are useful on food preparation surfaces such as meat cutting surfaces and food processing equipment.

B. BACKGROUND OF THE INVENTION

Foods provided for human and animal consumption, as a matter of necessity, need to be prepared in an environment which ensures the integrity of the product to be ingested. However, the food itself may often create certain environmental "by-products" which effect product quality.

For example, the preparation of meat can be a messy process which results in protein and fat residue, that if left uncleaned, could provide an active basis for bacterial growth. Constraints on the meat preparation may be further complicated by the preparation surface.

For example, meat may be cut on a metal, wooden, or plastic surfaces such as those made from materials like polyethylene. Over time, these boards may be scored, creating holes, crevices or openings for the ready deposition of residue such as meat blood and cutting scraps. If the cutting board is used in a retail facility such as a grocery store, butchery, or delicatessen, the staining caused by the meat blood may prove unsightly. Even further, the proteinaceous residue may prove a threat to public health.

In the past, food preparation surfaces have often been cleaned with aqueous solutions of bleach. However, scored or roughened cutting surfaces may be difficult to clean. Cutting residues may form in the cracks and crevices of the roughened cutting surface. At the same time, cleaning of these cracks and crevices can be difficult with the casual wiping which is a common practice. As a result, by-products, such as blood and meat scraps, may not be removed from the cutting surface. Further complicating the cleaning process is that many cutting surfaces are positioned vertically, on-side, when not in use. Any cleaning fluid which is applied to the board either runs off before contacting the entire surface, or is not in contact with staining and residue long enough to clean, bleach, or sanitize the cutting surface.

Previous compositions used for cleaning include Finely et al., U.S. Pat. No. 5,348,682 which teaches an aqueous composition of hypochlorite, polycarboxylate polymer, amine oxide surfactant, and optional fatty acid. The composition is disclosed as useful for cleaning bathroom fixtures and surfaces. Wise, U.S. Pat. No. 5,384,061 discloses an aqueous composition of chlorine bleach, polycarboxylate polymer, phytic acid, stabilizing agent and buffer. The Wise composition is disclosed as useful for dishwashing as a thickened detergent. Other dishwashing detergents are disclosed in Ahmed, U.S. Pat. No. 5,185,096; Gabriel et al., U.S. Pat. No. 5,510,047; and Rupe et al., U.S. Pat. No. 4,116,851.

However, none of these patents address concerns with food preparation surfaces or concerns of cleaning, bleaching, and sanitizing surfaces exposed to oxidizable or proteinaceous residue from foods such as meat. As a result, there is a need to provide compositions and method which may be used to clean, bleach, and sanitize food preparation surfaces, utensils, and equipment.

C. SUMMARY OF THE INVENTION

In accordance with one aspect of the invention there is provided a method of cleaning a food preparation surface by applying a thickened, noncorrosive composition to the surface. The composition includes a hypochlorite bleach to reduce staining on the surface, an alkalinity source to provide a compositional pH of from about 10 to 14, a thickening agent to promote thickening and adhesion of the thickened, noncorrosive composition to the surface upon application, and a balance of water.

In accordance with a further aspect of the invention, there is provided a thickened surface cleaning composition comprising a hypochlorite bleach to reduce staining, a thickening agent to provide increased viscosity, a source of alkalinity to provide a compositional pH of about 10 to 14, a surfactant to provide detergency to the composition, and a balance of water.

In accordance with an alternative aspect of the invention, there is provided a method of cleaning a substantially vertical surface with an adherent, thickened, noncorrosive composition. The method comprises applying the composition to the substantially vertical surface. The composition includes from about 0.1 to 10 wt-% of available chlorine provided by a chlorine source, from about 0.1 to 10 wt-% of a colloid forming clay, from about 0.1 to 25 wt-% of an alkali source providing a compositional pH of greater than about 11, and a balance of water. The composition has a Brookfield viscosity ranging from about 1,000 to 10,000 Cps at 25° C. when measured with a #4 spindle at 20 rpm. Upon application, at least about 75 wt-% of the applied cleaner adheres to the surface of application for at least about 30 minutes.

The invention includes methods and composition for cleaning food preparation surfaces. Alternatively, the composition of the invention may be used to clean vertical hard surfaces in kitchen and bathroom areas. The invention provides an adherent, noncorrosive cleaning composition. The invention provides a composition which is adherent to the surface of application even when positioned substantially vertically. Up to about 75 wt-%, preferably up to about 85 wt-% and most preferably up to about 95 wt-% of the applied composition may be retained on the surface of application after about 30 minutes at ambient temperatures, when the surface is held substantially vertically.

The methods and compositions of the invention are also noncorrosive, providing less than about 300 mils/year of aluminum reduction, and preferably less than about 100 mils/year of aluminum reduction when tested in accordance with United States Department of Transportation Hazardous Material Regulation 173.136. Generally, the composition of the invention has a Brookfield viscosity ranging from about 1000 to 10,000 Cps and more preferably from about 4000 Cps to 10,000 Cps when measured at 25° C. with a #4 spindle at 20 rpm.

Further, the invention also provides sanitizing antimicrobial efficacy upon application. A sanitizer is an agent that reduces the number of bacterial contaminants to safe levels as judged by public health requirements. Practically, a sanitizer must result in 99.999% reduction (5 log order reduction) for given organisms as defined by *Germicidal and Detergent Sanitizing Action of Disinfectants*, Official Methods of Analysis of the Association of Official Analytical Chemists, paragraph 960.09 and applicable sections, 15th Edition, 1990 (EPA Guideline 91-2).

Further, the invention preferably provides a surface which is free of oxidizable residue within 60 minutes and preferably within 30 minutes after application of the composition of the invention.

D. DETAILED DESCRIPTION OF THE PREFERRED EMBODIMENTS

The invention includes methods and compositions for cleaning surfaces, including food cooking and preparation surfaces including utensils and equipment. According to the invention, a thickened, noncorrosive composition is applied to the intended surface. The thickened composition includes a hypochlorite bleach to reduce, and preferably remove, staining on the surface, an anionic surfactant to provide detergency, a source of alkalinity such as sodium hydroxide, and a thickening agent to promote adhesion of the thickened, noncorrosive composition to the surface, once applied.

THE COMPOSITION

The composition of the invention generally comprises a source of bleach to destain the surface of application. Generally, any bleach may be used which removes any oxidizable stain and residue from the surface of application. Preferably, the surface of application will be free of oxidizable substances after application of the composition of the invention. Preferably, the bleach used in the composition of the invention also provides sanitizing antimicrobial efficacy when applied to the composition of the invention.

One preferred class of bleaches includes hypochlorite bleaches. Hypochlorite bleach generating compounds suitable for use in the composition of the invention are those water soluble, dry solid materials which generate hypochlorite ions on contact with, or dissolution in, water. The preferred hypochlorite compounds are alkali and alkaline earth hypochlorites, for example sodium, potassium and lithium hypochlorites as well as calcium hypochlorites.

The hypochlorite generating compounds are generally soluble in the product composition. Examples thereof are the dry, particulate heterocyclic N-chloroimides such as trichlorocyanuric acid, dichlorocyanuric acid and salts thereof such as sodium dichlorocyanurate and potassium dichlorocyanurate. The corresponding dichloroisocyanuric and trichloroisocyanic acid salts can also be used. Other N-chloroimides may also be used such as N-chlorosuccinimide, N-chloromalonimide, N-chlorophthalimide and N-chloronaphthalimide. Additional suitable N-chloroimides are the hydantoins such as 1,2-dichloro-5,5-dimethylhydantoin; N-monochloro-5,5-dimethylhydantoin; methylene-bis(N-chloro-5,5-dimethylhydantoin); 1,3-dichloro-5-methyl-5-isobutylhydantoin; 1,3-dichloro-5-methyl-5-ethylhydantoin; 1,3-dichloro-5,5-diisobutylhydantoin; 1,3-dichloro-5-methyl-5-n-amylhydantoin; and the like.

Other useful hypochlorite-liberating agents are trichloromelamine and dry, particulate, water soluble anhydrous inorganic salts such as lithium hypochlorite and calcium hypochlorite. The hypochlorite liberating agent may, if desired, be a stable, solid complex or hydrate such as sodium p-toluene-sulfo-chloramine-trihydrate (Chloramine-T), sodium benzene-sulfo-chloramine-dihydrate (Chloramine B), calcium hypochlorite tetrahydrate, or chlorinated trisodium phosphate containing 0.1 to 10 wt-% available chlorine produced by combining trisodium phosphate in its normal $Na_3PO_4 12H_2O$ form and an alkali metal hypochlorite (e.g. sodium hypochlorite).

The preferred sources of hypochlorite are dichloro- and trichloroisocyanurates, sodium hypochlorite, lithium hypochlorite, calcium hypochlorite, Chloramine-T (p-Toluenesulfochloramine), and Chloramine-B (sodium benzenesulfochloramine dihydrate).

The composition should contain sufficient chlorine bleach compound to provide about 0.1 to 10 wt-% of available chlorine, as determined, for example, by acidification of the composition with sulfuric acid and iodometric titration with sodium thiosulfate monitored by a potentiometer.

For example, a composition containing about 0.2 to 18 wt-% of sodium dichloroisocyanurate dihydrate (56 wt-% Av. Cl) contains or provides about 0.1 to 10 wt-% available chlorine. A composition containing about 1.8 to 14 wt-% sodium dichloroisocyanurate dihydrate contains about 1 to 8 wt-% of available chlorine ("Av. Cl") and is especially preferred. A composition containing about 1.6 to 12.3 wt-% calcium hypochlorite contains about 1 to 8 wt-% available chlorine. A composition containing about 3.6 to 64.3 wt-% of sodium hypochlorite (14 wt-% Av. Cl) contains about 0.5 to 9 wt-% of available chlorine. A composition containing about 7.1 to 57.1 wt-% of sodium hypochlorite (14% w/v) contains about 1 to 8 wt-% of available chlorine. Desirably the proportion of chlorine bleach liberating compound employed will be such as to yield a product which contains from about 0.1% to about 10 wt-% available chlorine on a total weight basis, preferably 0.5 to 9 wt-% and more preferably 1 to 8 wt-% available chlorine. The amount of available chlorine corresponds to 2.8 to 282 milli mole a, preferably 14 to 254 milli mole % and more preferably 28 to 226 milli mole % chlorine.

The composition of the invention also comprises a thickener. The thickeners or suspending agents that can be used in accordance with the invention to provide the aqueous medium with thickened properties. Organic polymeric thickeners and inorganic colloid forming clay materials are examples of those thickeners which may be used. The thickeners should be stable to high alkalinity and stable to chlorine bleach compounds such as sodium hypochlorite.

Useful organic polymeric thickeners include polycarboxylate polymers having a molecular weight from about 500,000 to about 4,000,000, preferably from about 1,000,000 to about 4,000,000, with, preferably, from about 0.5% to about 4% crosslinking. Preferred polycarboxylate polymers include polyacrylate polymers including those sold under trade names Carbopol®, Acrysol® ICS-1 and Sokalan®. The preferred polymers are polyacrylates. Other monomers besides acrylic acid can be used to form these polymers including such monomers as ethylene and propylene which act as diluents, and maleic anhydride which acts as a source of additional carboxylic groups.

The molecular weight and level of polycarboxylic polymer may be adjusted to give the desired product stability at the proper viscosity. The typical range of polycarboxylate polymer is from about 0.1 wt-% to about 10 wt-%, preferably from about 0.5 wt-% to about 8 wt-%, more preferably from about 0.5 wt-% to about 6 wt-% of the composition.

The preferred thickeners comprise colloid-forming clays, for example, such as smectite and/or attapulgite types. Inorganic colloid forming clays tend to provide higher stability in the presence of chlorine and do not thin when subjected to shear. The amount of the thickener used will depend on the particular thickener used, but sufficient thickener is added to the formulation to provide the composition with a thixotropy index of about 2 to 15, more preferably about 2 to 10. The thixotropy index is the ratio of the apparent Brookfield viscosity (#4 spindle at 25° C.) of the 3 rpm measurement to the 30 rpm measurement, after 1 minute of shear.

The clay materials which function in the instant composition as thickening and corrosion protection agents can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonite) and attapulgites (or polygorskites).

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_{2O5})_2(OH)_2$ and $Mg_3(Si_2O_5)(OH)_2$, for the aluminum and magnesium oxide type clays, respectively. It is to be recognized that the range of the water of hydration in the above formulas may vary with the processing to which the clay has been subjected.

Commercially available clays include, for example, montmorillonite (bentonite), volchonskoite, nontronite, beidellite, hectorite, saponite, sauconite and vermiculite. The clays herein are available under various trade names such as Thixogel No. 1 and Gelwhite GP from Georgia Kaolin Company, Elizabeth, N.J. (both montmorillonites); Volclay BC and Volclay No. 325, from American Colloid Company, Skokie, Ill.; Black Hills Bentonite BH 450, from International Minerals and Chemicals; Veegum Pro and Veegum F, from R. T. Vanderbilt (both hectorites); Barasym NAS-100, Barasym NAH-100, Barasym SMM 200, and Barasym LIH-200, all synthetic hectorites and saponites marketed by Baroid Division, NL Industries, Inc.

A second type of expandable clay material useful in the instant invention is classified geologically as attapulgite (polygorskite). Attapulgites are magnesium-rich clays having principles of superposition of tetrahedral and octahedral unit cell elements different from the smectites.

A typical attapulgite analyses yields 55.02% $SiO_2$; 10.24% $Al_2O_3$; 3.53% $Fe_2O_3$; 10.45% MgO; 0.47% $K_2O$; 9.73% $H_2O$ removed at 150° C.; 10.13% $H_2O$ removed at higher temperatures.

Like the smectites, attapulgite clays are commercially available. For example, such clays are marketed under the tradename Attagel, i.e. Attagel 40, Attagel 50 and Attagel 150 from Engelhard Minerals & Chemicals Corporation.

The preferred clay thickeners comprise the inorganic, colloid forming clays of smectite and/or attapulgite types. Preferred clays include products from Vanderbilt Chemical Company such as VanGel O®. Clay thickeners may be used in amounts of about 0.1 to 10 wt-%, preferably 0.5 to 8 wt-% and more preferably 0.5 to 6 wt-%.

In accordance with the invention, a builder may also be used in the composition of the invention. Builders complex hardness ions such as Mg and Ca, maintain the pH of the composition and increase the efficacy of the cleaning system. Generally, any number of builders may be used which are stable in bleach, and especially chlorine bleach, compositions. Generally, any builder used may be organic or inorganic.

One preferred builder salt which may be used with the invention is an alkali metal polyphosphate such as sodium tripolyphosphate ("STPP") or potassium tripolyphosphate ("KTPP") or a mixture thereof. In place of all or part of the alkali metal polyphosphate one or more other detergent builder salts can be used. Other suitable builder salts are alkali metal borates, phosphates and carbonates and bicarbonate, and mixtures thereof.

Specific examples of such builders are sodium tetraborate, sodium nitrilotriacetate, sodium pyrophosphate, potassium pyrophosphate, sodium bicarbonate, sodium hexametaphosphate, sodium sesquicarbonate, sodium mono-and diorthophosphate and potassium bicarbonate, and mixtures thereof. Other useful builders include the Dequest® product line of phosphates such as tetrasodium 1-hydroxyethylidene-1,1-diphosphonate and its acid form (Dequest® 2016 and 2010, respectively) as well as pentasodium diethylene triamine pentamethylene phosphate and its acid form (Dequest® 2066 and 2060, respectively). Also useful are phosphate compounds sold by Witco such as Emphos 10TP.

The builder salt, e.g. NaTPP or KTTP or mixtures thereof, may be used in the composition of the invention in an amount of up to about 20 wt-%, preferably about 1 to 15 wt-% and more preferably about 3 to 13 wt-%.

Inorganic builders such as STPP or KTTP may be replaced in whole or in part by organic builder salts. Since the compositions of this invention are generally highly concentrated, and, therefore, may be used at relatively low dosages, it may be desirable to supplement any phosphate builder (such as sodium tripolyphosphate) with an auxiliary builder such as an alkali metal polycarboxylic acid. Suitable alkali metal polycarboxylic acids are alkali metal salts of maleic and acrylic acid, and salts thereof. Also useful are alkali metal polyacrylates, and polyacrylate-maleate copolymers that are stable in the presence of chlorine bleach, (e.g. sodium polyacrylate-maleic copolymers). When used organic builders may be present in a concentration ranging from 0 to 10 wt-%, preferably from 2 to 8 wt-%, and more preferably from 3 to 6 wt-% based on the composition as a whole.

Generally, the composition of the invention may also comprise a surfactant. Preferably, the surfactant is stable in the presence of high alkalinity and bleach, including chlorine bleaches. Generally, anionic surfactants are preferred for use in the composition of the invention although certain other surfactants may be used. The anionic surfactants provide detergency and may increase viscosity. Further, the surfactants hydrate and stabilize the inorganic thickening agent.

Exemplary anionic surfactants which are suitable for the compositions of the invention include, but are not limited to, water soluble alkyl and alkyl ether sulfates and sulfonates, containing from about 8 to about 18 carbon atoms.

Specific examples of sulfate salts which can be employed in the compositions of the invention include sodium or potassium lauryl sulfate, sodium or potassium stearyl sulfate, sodium or potassium palmityl sulfate, sodium or potassium decyl sulfate, sodium or potassium myristyl sulfate, potassium dodecyl sulfate, sodium or potassium tallow sulfate, sodium or potassium coconut sulfate, magnesium coconut sulfate, calcium coconut sulfate, and mixtures thereof.

Sulphonated surfactants are also useful in the invention including alkyl, aryl, and alkyl/aryl sulphonates such as alkai metal $C_{10}$–$C_{18}$ alkyl/aryl sulphonates such as sodium alkyl benzene sulphonates and sodium dodecyl benzene sulphonate. Also useful are alpha-olefin sulphonates, alkyl naphthalene sodium sulphonates and the like. A preferred sulfonated anionic surfactant is the alkali metal salt of secondary alkane sulfonates, an example of which is the Hostapur SAS from Hoechst Celanese.

Certain chlorine stable surfactants which are not anionic may also be used such as amine oxides like alkyl $C_{12-16}$ dimethyl amine oxide, decyldimethyl amine oxide, and octadecyl dimethyl amine oxide available as Barlox 12, 10S and 18S, respectively; and carboxylate compounds such as Emcol CBA 50 from Witco (trideceth-7 carboxylic acid).

Preferably, anionic linear or branched alkyl diphenyl ether sulphonates are used such as those available from Dow Chemical Co. as Dow Fax® 3B-2, 2A-1, and C6L. These surfactants may be either mono or di-alkyl as well as mono or di-sulphonate. Generally, the surfactant may be used at a concentration of about 0 to 10 wt-%, preferably 1 to 6 wt-%, and more preferably 1 to 4 wt-% of the composition as a whole.

The composition of the invention may also comprise a stabilizing agent useful in maintaining a homogeneous mixture of bleach, thickening agent, and alkali source. Generally, the stabilizing agent is preferably stable in the presence of bleaches, and chlorine bleaches in particular. One preferred class of stabilizing agents includes fatty acids such as the higher aliphatic fatty monocarboxylic acids having from about 10 to about 40 carbon atoms, more preferably from about 10 to 30 carbon atoms, and especially preferably from about 12 to 18 carbon atoms, inclusive of the carbon atom of the carboxyl group of the fatty acid.

The aliphatic radicals are saturated and can be straight or branched. Straight chain saturated fatty acids are preferred. Mixtures of fatty acids may be used, such as those derived from natural sources, such as stearic fatty acid, tallow fatty acid, coco fatty acid, soya fatty acid, etc., or from synthetic sources available from industrial manufacturing processes. The fatty acids should be fully saturated in order to prevent undesirable reaction with the hypochlorite. Preferably, the fatty acid used has a low iodine value, that is less than about 2, and preferably less than about 1.

Examples of the fatty acids which may be used in the invention include, for example, decanoic acid, lauric acid, dodecanoic acid, palmitic acid, myristic acid, stearic acid, oleic acid, cicosanoic acid, tallow fatty acid, coco fatty acid, soya fatty acid and mixtures of these acids. Stearic acid mixed with palmitic acid available in the Industrene product line from Witco is generally preferred.

Generally, the amounts of the fatty acid stabilizer that may be used are in the range of from about 0.05 to 5 wt-%, preferably from about 0.1 to 4 wt-%, especially preferably from about 0.5 to 2 wt-%, provide the desired long term stability and absence of phase separation.

In order to provide an alkaline pH, the composition comprises an alkalinity source. Generally, the alkalinity source raises the pH of the composition to at least about 10 in 1 wt-% aqueous solution and generally to a range of from about 10 to 14, preferably from about 11 to 14, and most preferably from about 11 to 13.5.

This higher pH increases the efficacy of the soil removal and sediment breakdown when the chemical is placed in use and further facilitates the rapid dispersion of soils. The general character of the alkalinity source is limited only to those chemical compositions which have a greater solubility. That is, the alkalinity source should not contribute metal ions which promote the formation of precipitates or film salts. Exemplary alkalinity sources include silicates, hydroxides, phosphates, and carbonates.

Silicates useful in accord with this invention include alkali metal ortho-, meta-, di-, tri-, and tetrasilicates such as sodium orthosilicate, sodium sesquisilicate, sodium sesquisilicate pentahydrate, sodium metasilicate, sodium metasilicate pentahydrate, sodium metasilicate hexahydrate, sodium metasilicate octahydrate, sodium metasilicate nanohydrate, sodium disilicate, sodium trisilicate, sodium tetrasilicate, potassium metasilicate, potassium metasilicate hemihydrate, potassium silicate monohydrate, potassium disilicate, potassium disilicate monhydrate, potassium tetrasilicate, potassium tetrasilicate monohydrate, or mixtures thereof.

Generally, when a silicate compound is used as the alkalinity source in the invention, the concentration of the silicate will range from about 0 wt-% to 14 wt-%, preferably from about 1 wt-% to 12 wt-%, and most preferably from about 2 wt-% to 10 wt-%.

Alkali metal hydroxides have also been found useful as an alkalinity source in the invention. Alkali metal hydroxides are generally exemplified by species such as potassium hydroxide, sodium hydroxide, lithium hydroxide, and the like. Mixtures of these hydroxide species may also be used. While present, the alkaline hydroxide concentration generally ranges from about 0.1 wt-% to about 25 wt-%, preferably from about 0.5 wt-% to 20 wt-%, and most preferably from about 1 wt-% to 15 wt-%.

An additional source of alkalinity includes carbonates. Alkali metal carbonates which may be used in the invention include sodium carbonate, potassium carbonate, sodium or potassium bicarbonate or sesquicarbonate, among others. Preferred carbonates include sodium and potassium carbonates. When carbonates are used the concentration of these agents generally ranges from about 0 wt-% to 20 wt-%, preferably from about 1 wt-% to 15 wt-% and most preferably from about 4 wt-% to 10 wt-%.

Phosphates which may be used as an alkalinity source in accordance with the invention include cyclic phosphates such as sodium or potassium orthophosphate, alkaline condensed phosphates such as sodium or potassium pyrophosphate, sodium tripolyphosphate, sodium hexametaphosphate, and the like. In using phosphates the concentration will generally range from 0 wt-% to 20 wt-%, preferably from 1 wt-% to 15 wt-%, and most preferably 3 wt-% to 13 wt-%.

A summary of the concentration ranges for the composition of the invention may be found in Table 1.

TABLE 1

| | (wt - %) | | |
|---|---|---|---|
| | Useful | Preferred | More Preferred |
| Bleach (wt - % active) | 0.1–10 | 0.5–9 | 1–8 |
| Thickener | 0.1–10 | 0.5–8 | 0.5–6 |
| Builder | 0.1–20 | 1–15 | 3–13 |
| Surfactant | 0.1–10 | 1–6 | 1–4 |
| Stabilizer | 0.05–5 | 0.1–4 | 0.1–2 |
| Alkali Source | 0.1–25 | 0.5–20 | 1–15 |
| Water | Balance | Balance | Balance |
| pH | 10–14 | 11–14 | 11–13.5 |

FORMULATION AND APPLICATION

The thickened noncorrosive composition of the invention may be prepared by any means known to those with skill in the art. Generally, water, a source of alkalinity such as sodium hydroxide, and the thickener are added to a mixing vessel and mixed for a period of time sufficient to provide a homogenous mixture, about 30 minutes. These constituents may be added slowly to ensure complete dissolution. Once homogenous, a builder such as sodium tripolyphosphate may be added to the system with continued mixing up to about 2 hours. A pre-mix of water, fatty acid, and surfactant may then be prepared in a separate mixing vessel by mixing with heating up to 180° F. Once the pre-mix is emulsified through heat and mixing action, it may be added to main batch of thickener, water, and alkali source. The bleach is then added to the main batch after cooling to room temperature with continued mixing. Appropriate testing may be done to ensure the necessary presence of all constituents, for example, bleach, thickener, and builder.

Once formulated, the composition of the invention may be applied to any food preparation surface to facilitate cleaning. After application for a time period ranging from about 1 minute to 40 minutes, the composition of the invention may be wiped or rinsed from the surface of application. The invention may be used on surfaces and food processing equipment made of metal comprised of metal-alloys, wood and wood laminates as well as plastics such as polymers of alpha-olefins monomers like polyethylene and polypropylene. The composition and methods of the invention may also be used on any other vertical or substantially vertical surfaces in any environment requiring cleaning, bleaching, or sanitization.

WORKING EXAMPLES

The following examples illustrate the characteristics and properties of the invention. However, these examples do not limit the invention. The invention is limited only by the claims appended to this specification.

Example 1

A cleaner was formulated according to the invention, to determine the viscosity properties of the system. A master batch was formulated first.

| | Constituent | Wt - % |
|---|---|---|
| Master Batch | Water | 58.50 |
| | VanGel O (clay thickener) | 2.00 |
| | Sodium Hydroxide (50%) | 3.00 |
| | Sodium Tripolyphosphate (FMC Food grade) | 10.00 |

Once formulated a premix was mixed and heated to 180° F.

| | | |
|---|---|---|
| Premix | Water | 5.00 |
| | Stearic Acid | 0.50 |
| | Dowfax 3B2 (anionic surfactant) | 1.00 |

The premix was then mixed with the master batch and the system was cooled with reduced agitation.

| | |
|---|---|
| Graphol Green | 0.0001 |
| NaOCl (10 wt - % Av. Cl) | 20.00 |
| | 100.00 |

VanGel O® was slowly added, while mixing, to water. The Master Batch was mixed for one hour to a homogeneous, no-lumpy consistency. NaOH was added, and mixed for 10 minutes. STTP was added slowly and mixed for one hour (temperature 94° F.). The premix was then added (temperature 104° F.), and the system cooled to 80° F. and the NaOCl bleach was then added.

Viscosity data (Brookfield), 20 rpm, #4 spindle:

| Viscosity | Day |
|---|---|
| 1400 cps | 0 |
| 2000 cps | 1 |
| 4100 cps | 14 |
| 7300 cps | 76 |

Example 2

Example 2 was formulated in the same manner as Example 1.

| | Constituent | Wt - % |
|---|---|---|
| Master Batch | Water | 60.00 |
| | VanGel O | 2.00 |
| | Sodium Hydroxide (50%) | 3.00 |
| | Sodium Tripolyphosphate (FMC, High phase 1) | 10.00 |
| Premix | Water | 5.00 |
| | Stearic Acid | 0.50 |
| | Dowfax 3B2 | 1.00 |
| | NaOCl (10 wt - % Av. Cl) | 18.50 |

| Day | Available Chlorine (Av. Cl) (wt - %) | Temperature |
|---|---|---|
| 0 | 2.02 | Ambient |
| 7 | 1.99 | Ambient |
| 7 | 1.88 | 100° F. |

| Viscosity | Day |
|---|---|
| 1900 cps | 0 |
| 4500 cps | 7 |
| 4700 cps | 8 |
| 8500 cps | 80 |

Example 3

Another cleaner was formulated with the constituents shown in Table 2 using the formulatory procedure of Examples 1 and 2.

TABLE 2

Block Whitener Formulation

| Ingredients | Wt - % |
|---|---|
| Water, Deionized | 63.499 |
| Dye, Graphtol Green 5869-3 (pigment) | 0.0010 |
| Ven Gel O[1] | 2.0 |
| Sodium Hydroxide (50%) | 3.0 |
| Sodium Tripolyphosphate-Anhydrous[2] | 10.0 |
| Stearic Acid[3] | 0.50 |
| Dowfax C6L[4] | 1.0 |
| NaOCl (12.5%) | 20.0 |

[1]Van Gel O, a clay thickener, is available from RT Vanderbilt Co.
[2]Sodium Tripolyphosphate is a high phase - 1, available from FMC.
[3]Stearic Acid powder is available as Industrene 8718 from Witco Corp.
[4]Dowfax C6L, an anionic surfactant is available from Dow Chemical.

Example 3 had the following physical and chemical properties:

Brookfield Viscosity—2000 cps (fresh, 0 hours)

Available Chlorine—2.0 wt-%

Specific Gravity—1.14 pH—13.4 (neat)

Aged Viscosity—5000 cps (2 days)

Free Alkalinity—1.85 wt-%

Total Alkalinity—4.03 wt-%

Example 4

Further production batches (500 gallons ) of the composition were formulated in accordance with Example 3. Viscosity data for these samples may be found in Table 3.

TABLE 3

| Brookfield Viscosity Results (20 rpm, #4 spindle) | | | | |
|---|---|---|---|---|
| Example | 1 Day | 4–5 Days | 8–10 Days | 18–20 Days |
| 4A | 3500 | 4700 | 4500 | 4400 |
| 4B | 3000 | 6400 | 6200 | 4000 |
| 4C | 2800 | 5800 | 4300 | 4200 |
| 4D | 2900 | 5500 | 6200 | 6100 |
| 4E | 2600 | 4900 | 5600 | 5900 |

Example 5

Two additional Examples were prepared and analyzed as in Examples 1 and 2.

TABLE 4

| Ingredients | 5A | 5B |
|---|---|---|
| Water | 67.80 | 67.80 |
| Ven Gel O[1] | 2.00 | — |
| Carbopol 672[2] | — | 1.00 |
| Sodium Hydroxide (50%) | 3.00 | 4.00 |
| Sodium Tripolyphosphate-Anhydrous | 10.00 | 10.00 |
| Stearic Acid[3] | 0.50 | 0.50 |
| Dowfax C6L[4] | 1.00 | 1.00 |
| Pylaklor Green S-722 | 0.003 | 0.003 |
| NaOCl (12.5 wt - % Active) | 16.00 | 16.00 |

[1]Van Gel O, a clay thickener is available from RT Vanderbilt Co.
[2]Carbopol 672, an organic thickener is available from BF Goodrich.
[3]Stearic Acid is available as Inudstrene 8718 from Witco Corp.
[4]Dowfax C6L, an anionic surfactant is available from Dow Chemical.

These examples were then evaluated for various properties:

| | 5A | 5B |
|---|---|---|
| Brookfield Viscosity (25° C., #4 spindle, 20 rpm) | 2800 | 7800 |
| Available Chlorine (wt - %) | 1.88 | 1.71 |
| Specific Gravity | 1.14 | 1.14 |
| pH | 13.08 | 13.21 |
| Aged Viscosity (7 days) | 4500 | 10,000 |
| Free Alkalinity (wt - %) | 1.85 | 1.71 |
| Total Alkalinity (wt - %) | 4.03 | 4.03 |

Example 6

The composition of Example 2 was then used to determine if the composition of the invention meets the corrosive standard for aluminum according to Hazardous Material Regulation 173.136 for the U.S. DOT.

The National Association of Corrosion Engineers Standard TM0169-76 was used to determine whether the composition of the invention met the standard. Test coupons (1"×2") of 7075T6 aluminum were obtained from Metaspec, San Antonio, Tex. The coupons were cleaned with isopropanol, immersed in 70% nitric acid for 2 minutes followed by a hot water rinse, and finally rinsed in isopropanol and blown dry with a hair dryer. All coupons were weighed to the nearest 0.1 mg and then immersed in 400 ml of the neat test product solution in a wide mouth jar for 6 hours at 130° F. Following exposure the coupons were rinsed in hot water, immersed in 70% nitric acid for 2 minutes, dipped in isopropanol and blow dried. The coupons were weighed to the nearest 0.1 mg and the weight loss was calculated as mils/year penetration.

Corrosion (mils/year):

$$\text{wt. loss (mg)}/4\ \text{in}^2/.6\ \text{hr}/2.71(\text{gm}/\text{cm}^3)/16.4(\text{cm}^3/\text{in}^3)\times 24(\text{hr}/\text{day})\times 365\ \text{days}/\text{yr}\times 1000\ \text{mils}/\text{in.}/1000\ \text{mg}/\text{g} = \text{wt. loss (mg)}\times 8.21\ \text{mils}/\text{mg. year}$$

TABLE 5

| | Weight (mg) | | Corrosion | Avg. Corr. |
|---|---|---|---|---|
| Sample | Initial | Final | (mils/yr.) | (mils/yr.)) |
| 1 | 5.5692 | 5.5583 | 89.5 | |
| 2 | 5.5022 | 4.9616 | 70.6 | 80 |

The composition of the invention met the U.S. DOT corrosive standard on aluminum of less than 246 mils/year.

Example 7

The composition of Example 2 was then analyzed to determine its dermal irritancy using standard test methods.

A study was undertaken to provide information on health hazards likely to arise form a single 4-hour exposure to a composition formulated in accordance with Example 2 by the dermal contact.

A group of New Zealand albino rabbits was received from Davidson's Mill Farm, South Brusnwick, N.J. The animals were singly housed in suspended stainless steel caging with mesh floors. Litter paper was placed beneath the cage and was changed at least three times per week. The animal room was temperature controlled and had a 12-hour light/dark cycle. The animals were fed Purina Rabbit Chow #5326 and filtered tap water was supplied ad libitum by automatic watering system.

Following acclimation to the laboratory, a group of animals was prepared by clipping (Oster model #A2-small) the dorsal area of the trunk free of hair. On the day after clipping, six healthy rabbits (3 male and 3 female) without pre-existing dermal irritation were selected for test. One intact test site, approximately 6 $cm^2$, was delineated on each animal.

Five-tenths of a milliliter of test material was applied to each dose site and covered with a 2×2" adhesive-backed gauze patch. The patch and entire trunk of each animal were then wrapped with 3" Durapore tape to avoid dislocation of the patch. Elizabethan collars were placed on each rabbit and they were returned to their designated cages.

After 4 hours of exposure to the test material, the patches and collars were removed and the test sites gently wiped with water and a clean towel to remove any residual test material, individual dose sites were scored according to the Draize scoring system (Draize, J. H., Woodward, G. and Calvery, H. O., Methods for the study of irritation and toxicity of substances applied topically to the skin and mucous membranes, *J. Pharmacol. Exp. Ther.* 1944:82:377–390) at approximately 1, 24, 48 and 72 hours after patch removal.

The classification of irritancy was obtained by adding the average erythema and edema scores for the 1, 24, 48 and 72 hour scoring intervals and dividing by the number of evaluation intervals (4).

The resulting Primary Dermal Irritation Index (PDII) was classified as follows:

| PDII | Classification |
|---|---|
| Less than 2.0 | Slightly irritating |
| 2.1–5.0 | Moderately irritating |
| Greater than 6.1 | Severely irritating |

All animals appeared active and healthy. Apart from the skin irritation noted below, there were no signs of gross toxicity, adverse pharmacologic effect or abnormal behavior.

One hour after test substance application, very slight to well-defined erythema and very slight to slight edema were noted at all treated sites. Overall, the incidence and severity of irritation persisted at all sites through 72 hours.

The Primary Dermal Irritation Index for the composition of Example 2 was 2.6.

TABLE 6

| | Hours | | | |
|---|---|---|---|---|
| | 1 | 24 | 48 | 72 |
| Erythema and Eschar | 1.5 | 1.3 | 1.3 | 1.5 |
| Edema | 1.3 | 1.2 | 1.2 | 1.2 |
| TOTAL (PDI)[1] | 2.8 | 2.5 | 2.5 | 2.7 |

Primary Dermal Irritation Index (PDII) : PDIfor1,24,48and72hrs = 2.6
[1]PDI = Average Erythema/Eschar + Average Edema The above specification, examples and data provide a complete description of the manufacture and use of the composition of the invention. Since many embodiments of the invention can be made without departing from the spirit and scope of the invention, the invention resides in the claims hereinafter appended.

The claimed invention is:

1. A method of cleaning a food preparation surface, said method comprising the step of applying a thickened, noncorrosive composition to the surface, said composition comprising:

(a) from about 0.1 wt-% to 10 wt-% of available chlorine provided by hypochlorite bleach to reduce staining on the surface;

(b) from about 0.1 wt-% to 25 wt-% of alkali metal hydroxide alkalinity source effective to provide a pH of from about 10 to 14 to said composition;

(c) from about 0.1 wt-% to 10 wt-% of an inorganic thickening agent to promote adhesion of said thickened, noncorrosive composition to the surface upon application;

(d) from about 0.05 wt-% to 5 wt-% of fatty acid stabilizer to maintain a homogenous mixture of said bleach, thickening agent, and alkalinity source; and (e) from about 0.1 wt-% to 10 wt-% of anionic surfactant effective to provide detergency to the thickened, noncorrosive composition said anionic surfactant selected from the group consisting of an alkylsulfate, an alkyl sulfonate, a disulphonate compound, an alkyl ether sulfate, an alkyd ether sulfonate, and mixtures thereof;

(f) a balance of water wherein said thickened noncorrosive composition has sanitizing antimicrobial efficacy.

2. The method of claim 1, wherein said food preparation surface is substantially vertical and upon application of said noncorrosive composition to the substantially vertical surface at least about 75 wt-% of the applied noncorrosive composition adheres to the surface for a time period up to about 30 minutes.

3. The method of claim 1, wherein upon application of said composition, said surface is substantially vertical.

4. The method of claim 1, wherein said hypochlorite bleach comprises sodium hypochlorite.

5. The method of claim 1, wherein said inorganic thickening agent comprises a colloid forming clay.

6. The method of claim 1, wherein said composition additionally comprises from about 0.1 wt-% to 20 wt-% builder, said builder selected from the group consisting of an alkali metal tripolyphosphate, a nitrilotriacetate compound, an alkali metal pyrophosphate, an alkali metal hexametaphosphate, a carbonate compound, a bicarbonate compound, a polyacrylate compound, and mixtures thereof.

7. The method of claim 6, wherein said builder comprises an alkali metal tripolyphosphate.

8. The method of claim 1, wherein said fatty acid has a low iodine value.

9. The method of claim 8, wherein said fatty acid is selected from the group consisting of stearic acid, palmitic acid, tallow fatty acid, coco fatty acid, oleic acid, myristic acid, and mixtures thereof.

10. The method of claim 1, wherein said stabilizer comprises stearic acid.

11. The method of claim 1, wherein said food preparation surface comprises a meat preparation surface.

12. The method of claim 11, additionally comprising the step of rinsing said composition from said food preparation surface.

13. The method of claim 11, wherein said food preparation surface comprises a material, said material selected from the group consisting of a metal alloy, wood, and a polymeric material.

14. A thickened had surface cleaning composition comprising:

(a) from about 0.1 wt-% to 10 wt-% of available chlorine provided by hypochlorite bleach to reduce staining;

(b) from about 0.1 wt-% to 10 wt-% of an inorganic thickening agent effective to provide increased viscosity;

(c) from about 0.1 wt-% to 25 wt-% of alkali metal hydroxide to provide a pH of about 10 to 14;

(d) from about 0.1 wt-% to 6 wt-% of an anionic surfactant to provide detergency to the composition;

(e) from about 0.05 wt-% to 5 wt-% of a fatty acid stabilizer effective to maintain a homogenous mixture of said bleach, thickening agent, and alkali metal hydroxide; and (f) a balance of water wherein said thickened hard surface cleaning composition has sanitizing antimicrobial efficacy.

15. The composition of claim 14, wherein said composition has a Brookfield viscosity ranging from about 1000 to 10,000 Cps. at 25° C. with a spindle of #4 at 20 rpm.

16. The composition of claim 14, wherein said composition has a pH of about 11 to 13.

17. The composition of claim 14, wherein said composition comprises from about 1 wt-% to 20 wt-% of an alkali metal hydroxide and the pH of said composition is greater than about 11.

18. The composition of claim 14, wherein said composition comprises:

(a) from about 0.1 wt-% to 10 wt-% of available chlorine provided by said hypochlorite bleach;

(b) from about 1 wt-% to 6 wt-% of a surfactant;

(c) from about 0.1 wt-% to 10 wt-% of a colloid forming clay inorganic thickening agent;

(d) from about 0.1 wt-% to 25 wt-% of sodium hydroxide;

(e) from about 1 wt-% to 15 wt-% of a builder; and (f) from about 0.05 wt-% to 5 wt-% of a stabilizer effective to maintain a homogenous mixture of bleach, thickening agent, and sodium hydroxide.

19. The composition of claim 18, wherein said hypochlorite bleach comprises sodium hypochlorite.

20. The composition of claim 18, wherein said builder is selected from the group consisting of an alkali metal tripolyphosphate, a nitrilotriacetate compound, an alkali metal pyrophosphate, an alkali metal hexametaphosphate, a carbonate compound, a bicarbonate compound, a polyacrylate compound, and mixtures thereof.

21. The composition of claim 18, wherein said builder comprises sodium tripolyphosphate.

22. The composition of claim 14, wherein said fatty acid has a low iodine value.

23. The composition of claim 14, wherein said fatty acid is selected from the group consisting of stearic acid, palmitic acid, myristic acid, tallow fatty acid, coco fatty acid, oleic acid, and mixtures thereof.

24. The composition of claim 18, wherein said stabilizer comprises stearic acid.

25. A method of cleaning a substantially vertical surface with an adherent, thickened, noncorrosive composition, said method comprising the step of applying said composition to the substantially vertical surface, said composition comprising:

(a) from about 0.1 to 10 wt-% of available chlorine provided by hypochlorite bleach;

(b) from about 0.1 to 10 wt-% of a colloid forming clay; and (c) from about 0.1 to 25 wt-% of an alkali metal hydroxide alkalinity source providing a compositional pH of greater than about 11;

(d) from about 0.1 to 10 wt-% of an anionic surfactant said anionic surfactant selected from the group consisting of a sulphate compound, a sulphonate compound, a disulphonate compound and mixtures thereof; and (e) from about 0.05 to 5 wt-% of a fatty acid stabilizer effective to maintain a homogenous mixture of said bleach, thickening agent, and alkali source wherein said composition has a Brookfield viscosity ranging from about 1000 to 10000 Cps at 25° C. when measured with a #4 spindle at 20 rpm and, upon application, at least about 75 wt-% of the applied cleaner adheres to the surface of application for at least about 30 minutes and said composition has sanitizing antimicrobial efficacy.

26. The method of claim 25, wherein upon application to the substantially vertical surface, at least about 85 wt-% of the applied cleaner adheres to the surface for a time period up to about 30 minutes.

27. The method of claim 25, wherein about 30 minutes after application of said composition, the surface of the application is free of oxidizable substances.

28. The method of claim 25, wherein said hypochlorite bleach comprises sodium hypochlorite.

29. The method of claim 25, wherein said composition comprises a builder selected from the group consisting of an alkali metal tripolyphosphate, a nitrilotriacetate compound, an alkali metal pyrophosphate, an alkali metal hexametaphosphate, a carbonate compound, a bicarbonate compound, a polyacrylate compound, and mixtures thereof.

30. The method of claim 29, wherein said builder comprises an alkali metal tripolyphosphate.

31. The method of claim 25, wherein said fatty acid is selected from the group consisting of stearic acid, palmitic acid, tallow fatty acid, coco fatty acid, oleic acid, myristic acid, and mixtures thereof.

32. The method of claim 25, wherein the surface comprises a material, said material selected from the group consisting of a metal alloy, wood, and a polymeric material.

33. The method of claim 1, wherein said composition has a viscosity effective to maintain said composition on said surface for a time sufficient to sanitize said surface, wherein said surface is vertical.

34. The composition of claim 14, wherein said composition has a viscosity effective to maintain said composition on said surface for a time sufficient to sanitize said surface, wherein said surface is vertical.

35. The method of claim 25, wherein said composition has a viscosity effective to maintain said composition on said surface for a time sufficient to sanitize said surface, wherein said surface is vertical.

* * * * *